US006939169B2

(12) United States Patent
Islam et al.

(10) Patent No.: US 6,939,169 B2
(45) Date of Patent: Sep. 6, 2005

(54) AXIAL COMPRESSION ELECTRICAL CONNECTOR

(75) Inventors: Nahid Islam, Westmont, IL (US); Joon Lee, Des Plaines, IL (US); Neil Thorburn, Edinburgh (GB)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/708,278

(22) Filed: Feb. 20, 2004

(65) Prior Publication Data

US 2005/0026496 A1 Feb. 3, 2005

Related U.S. Application Data

(60) Provisional application No. 60/481,152, filed on Jul. 28, 2003.

(51) Int. Cl.[7] ..... H01R 9/05
(52) U.S. Cl. ..... 439/578
(58) Field of Search ..... 439/578, 583; 174/75 C

(56) References Cited

U.S. PATENT DOCUMENTS

| | | | | |
|---|---|---|---|---|
| 4,995,832 A | | 2/1991 | Thommen et al. | |
| 5,083,945 A | | 1/1992 | Miskin et al. | |
| 5,096,444 A | | 3/1992 | Lu et al. | |
| 5,137,470 A | * | 8/1992 | Doles | 439/578 |
| 5,154,636 A | | 10/1992 | Vaccaro | |
| 5,167,533 A | | 12/1992 | Rauwolf | |
| 5,217,393 A | | 6/1993 | Del Negro et al. | |
| 5,281,167 A | * | 1/1994 | Le et al. | 439/578 |
| 5,857,865 A | | 1/1999 | Shimirak et al. | |
| 5,863,220 A | | 1/1999 | Holliday | |
| 5,879,191 A | | 3/1999 | Burris | |
| 5,938,474 A | | 8/1999 | Nelson | |
| 5,975,951 A | | 11/1999 | Burris et al. | |
| 5,997,350 A | | 12/1999 | Burris et al. | |
| 6,153,830 A | | 11/2000 | Montena | |
| 6,210,222 B1 | | 4/2001 | Langham et al. | |
| 6,471,545 B1 | | 10/2002 | Hosler, Sr. | |
| 6,676,446 B2 | | 1/2004 | Montena | |

FOREIGN PATENT DOCUMENTS

| | | |
|---|---|---|
| DE | 1101562 | 3/1961 |
| GB | 1421215 | 1/1976 |

* cited by examiner

*Primary Examiner*—Phuong Dinh
(74) *Attorney, Agent, or Firm*—Babcock IP, LLC

(57) ABSTRACT

An electrical connector adapted for interconnection with a helically corrugated outer conductor coaxial cable via axial compression. Threads formed in an interior bore of the connector body threadably engage helical corrugations of the outer conductor. Upon axial compression of an interface into an interference fit with the body, a leading edge of the outer conductor is deformed, creating a high quality uniform electrical interconnection and preventing unthreading of the cable from the connector. Gaskets environmentally sealing the various entry paths into the connector are also sealably compressed by the axial movement of the various connector components during axial compression.

20 Claims, 10 Drawing Sheets

AXIAL COMPRESSION ELECTRICAL CONNECTOR

CROSS REFERENCE TO RELATED APPLICATIONS

This application claims the benefit of U.S. Provisional Application No. 60/481,152 filed Jul. 28, 2003.

BACKGROUND OF INVENTION

1. Field of the Invention

The invention relates to an electrical connector. More particularly the invention relates to an electrical connector installable upon an electrical cable, having a helically corrugated outer conductor, by application of axial compression.

2. Description of Related Art

Connectors for corrugated outer conductor cable are used throughout the semi-flexible corrugated coaxial cable industry.

Previously, connectors have been designed to attach to coaxial cable using solder, crimping and or mechanical compression applied tangentially to the longitudinal axis of the cable. The quality of a solder connection may vary with the training and motivation of the installation personnel. Solder connections are time consuming and require specialized tools, especially during connector installation under field conditions. Mechanical compression connections may require compressive force levels and or special tooling that may not be portable or commercially practical for field installation use. Mechanical compression designs using wedging members compressed by tightening threads formed on the connector may be unacceptably expensive to manufacture.

In the case of a coaxial cable with a corrugated aluminum outer conductor the prior crimping may not adequately secure the desired connection because of the relative softness of the aluminum outer conductor.

Another form of a compression connection is via axial compression. In prior axial compression connectors a portion of a braided and or foil outer conductor is folded back upon itself and a ferrule forced over the folded outer conductor by a hand tool which applies axial compression. Because of the difficulty with folding a solid conductor back upon itself without tearing, this form of connector is unusable with a solid metallic outer conductor coaxial cable.

Competition within the cable and connector industry has increased the importance of minimizing installation time, required installation tools, and connector manufacturing/materials costs. Also, competition has focused attention upon ease of use, electrical interconnection quality and connector reliability.

Therefore, it is an object of the invention to provide an electrical connector and method of installation that overcomes deficiencies in such prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

The invention will be described in detail with respect to FIGS. 1–6 in a standard Type-F (CATV) connector interface for use with 75 ohm helically corrugated outer conductor coaxial cable. One skilled in the art will appreciate that the invention, as will be discussed herein below, is similarly applicable to other connector interfaces and or helically corrugated coaxial cable configurations.

Figure 1:
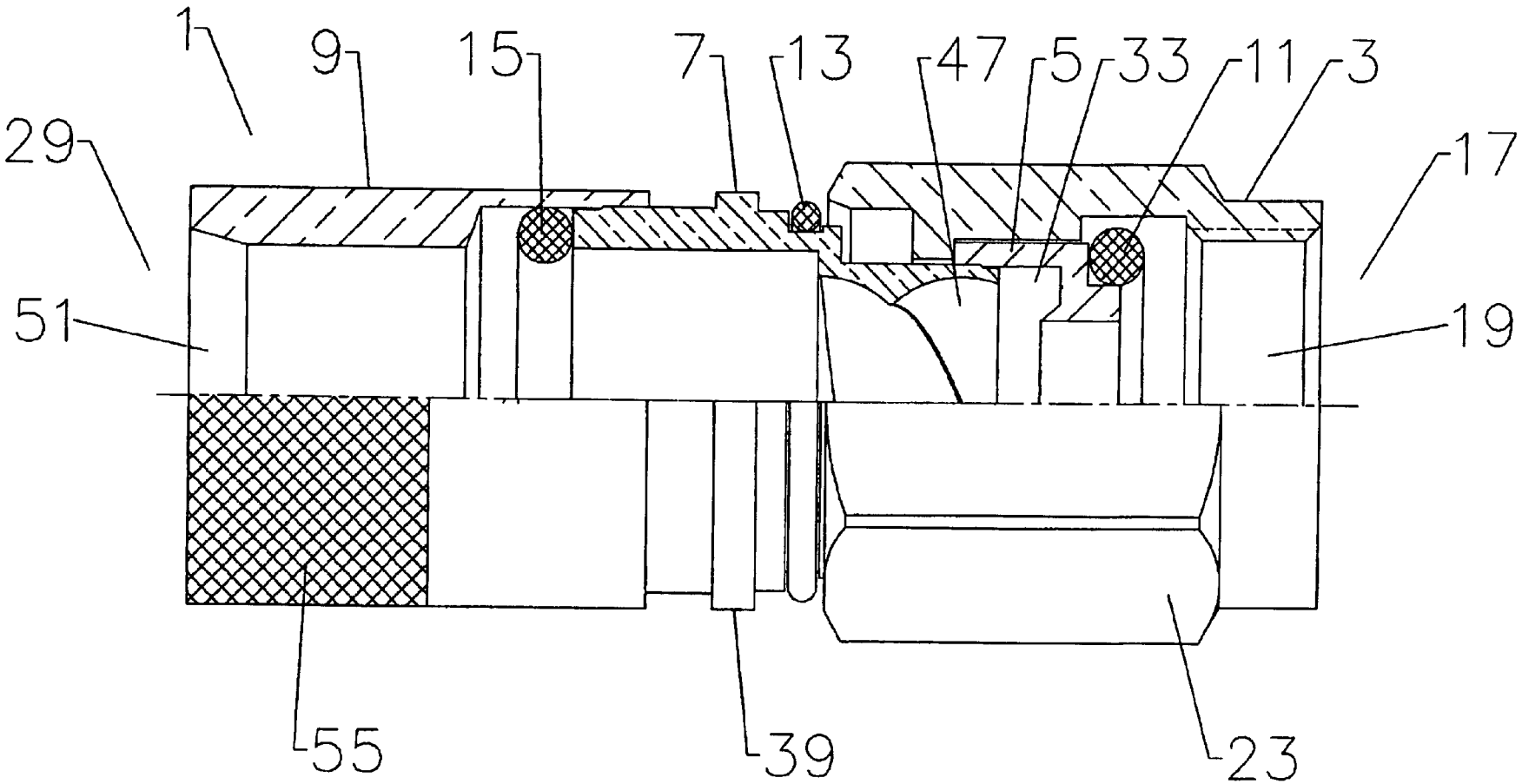
FIG. 1 is a combination external side view and partial cross sectional view of a connector according to a first embodiment of the invention.

As shown in FIG. 1, a connector 1 comprises a coupling nut 3 surrounding an interface 5 which mates to a body 7 that fits into a sleeve 9. A plurality of compressible and or deformable sealing gaskets, for example rubber or silicon o-rings, may be located around and within the connector 1 to environmentally seal the connection(s). A first gasket 11 is located between the coupling nut 3 and the interface 5, seated upon the interface 5, to seal an interconnection between the connector 1 and a female connector. A second gasket 13 is located between the coupling nut 3 and the body 7, seated upon the body 7, to seal the connection between the coupling nut 3 and the body 7. A third gasket 15 is located between the sleeve 9 and the body 7, for sealing between the body 7 and the outer sheath of the cable. If the connector 1 is to be installed in a dry environment, some or all of the gaskets may be omitted.

Figure 2B:
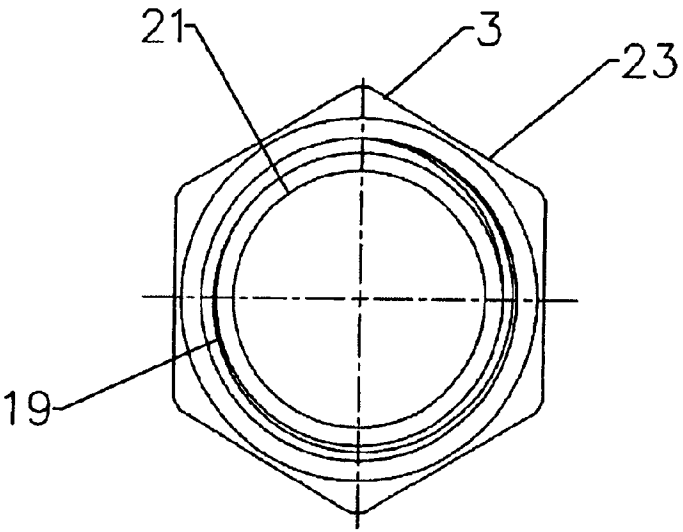
FIG. 2*b* is a an end view of the coupling nut of FIG. 1.
Figure 2A:
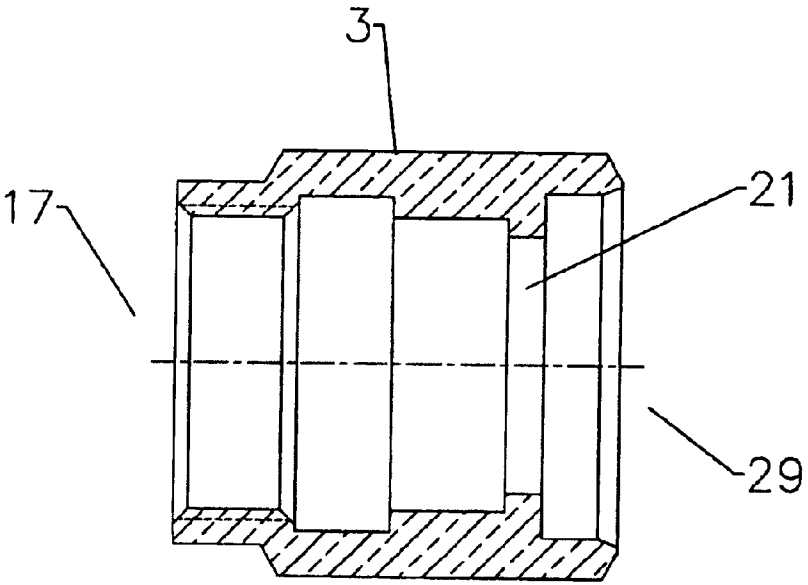
FIG. 2*a* is a cross sectional side view of the coupling nut of FIG. 1.

FIGS. 2*a* and 2*b* show the coupling nut 3 in greater detail. A connector end 17 of the coupling nut 3 has threads 19 formed on an inner radius of the coupling nut bore for coupling to a female F-type connector. An inward projecting retaining shoulder 21 has an inner diameter adapted to loosely fit over the connector end 17 of the body 7, but not the interface 5. A plurality of faces 23 are formed in the outer surface of the coupling nut 3 as tool mating surfaces for rotating the coupling nut 3 when threading the connector 1 to attach it to a female type F-connector via the threads 19.

Figure 3B:
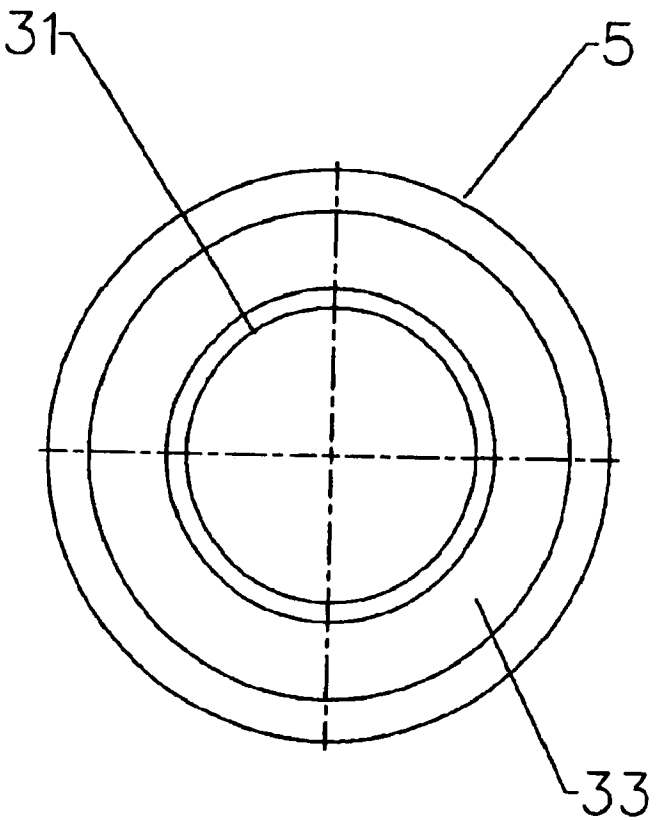
FIG. 3*b* is an end view of the interface of FIG. 1.
Figure 3A:
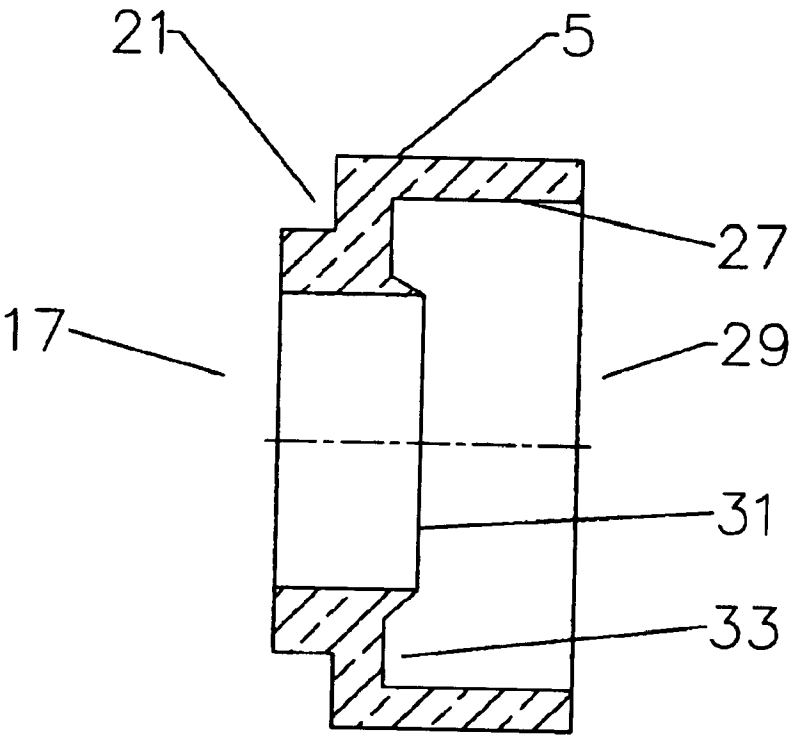
FIG. 3*a* is a cross sectional side view of the interface of FIG. 1.

FIGS. 3*a* and 3*b* show the interface 5 in greater detail. An interface shoulder 25 formed in the connector end 17 is adapted to seat the first gasket 11. A body coupling surface 27 has an inner diameter adapted to receive a connector end 17 of the body 5 in an interference fit. An angled guide surface 31 projects axially towards a cable end 29 to define a circular outer conductor groove 33 facing the cable end 29.

Figure 4B:
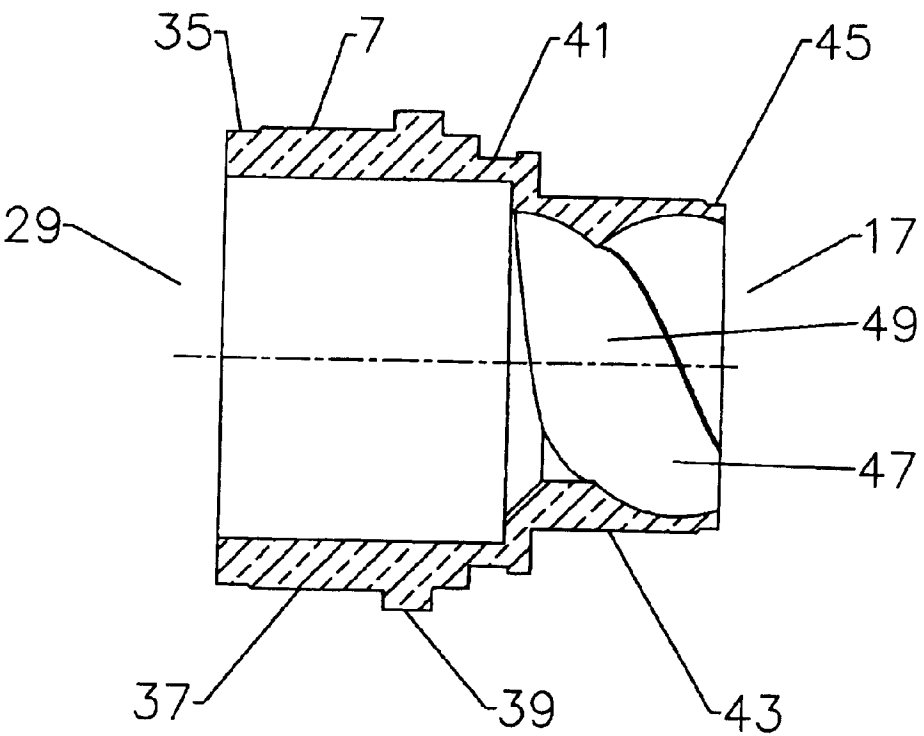
FIG. 4*b* is a cross sectional side view of the body of FIG. 1.
Figure 4A:
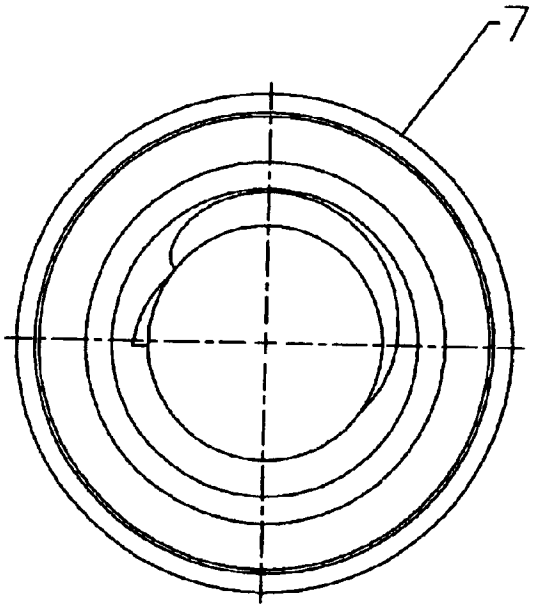
FIG. 4*a* is an end view of the body of FIG. 1.

FIGS. 4*a* and 4*b* show the body 7 in greater detail. A sleeve mounting guide surface 35 at the cable end 29 has an outer diameter adapted to initially receive and align the connector end 17 of the sleeve 9 as it is mounted for an initial interference fit. A sleeve mounting surface 37 having a slightly larger diameter is adapted to retain the connector end 17 of the sleeve 9 in a final interference fit. A ridge 39 projects radially outward to provide a stop for the sleeve 9 as it is moved axially onto the body 7. A groove 41 operates as a seat for the second gasket 13.

At the connector end 17 of the body 7, an interface mounting guide surface 45 has an outer diameter adapted to initially receive and align the body coupling surface 27 of the interface 5. An interface mounting surface 43 having a slightly larger diameter is adapted to retain the cable end 29 of the interface 3 in a final interference fit along the body coupling surface 27.

Outer conductor thread(s) 47 are formed projecting radially inward along an interface area 49 of a bore in the body 7. The outer conductor thread(s) 47 are adapted to threadably mate with the helical corrugations formed in the outer conductor of the desired coaxial cable. Here, dual threading adapted to mate with Coral (trademark) brand helically corrugated low cost, high performance coaxial cable manufactured by Andrew Corporation of Orland Park, Ill., is shown. A pair of helical corrugations in the outer conductor are oriented 180 degrees from each other. This unique water blocking aluminum cable is described in U.S. patent application Ser. No. 10/131,747 filed Apr. 24, 2002 also assigned to Andrew Corporation and hereby incorporated by reference in its entirety.

Alternatively, a cable interface area 49 with a single outer conductor thread 47 for conventional single threaded helically corrugated copper cable, for example as described herein below with respect to FIGS. 8*a–c*, may be applied.

Between the interface area 49 and the cable end 29 of the body 7, the bore has an increased diameter adapted to receive the desired coaxial cable with a protective outer sheath in place.

Figure 5B:
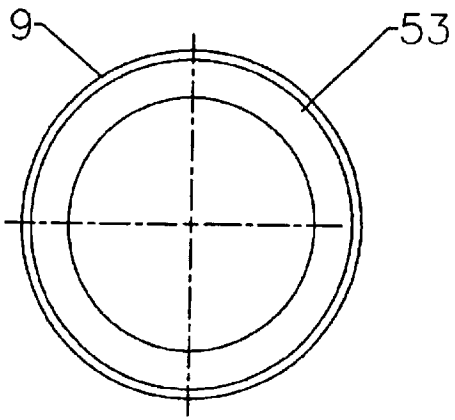
FIG. 5*b* is an end view of the sleeve of FIG. 1.
Figure 5C:
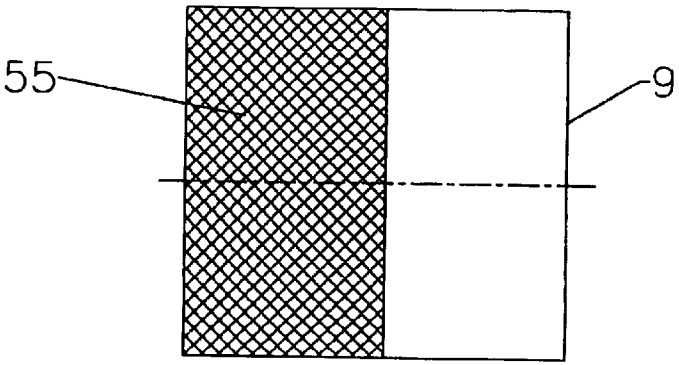
FIG. 5*c* is an external side view of the sleeve of FIG. 1.
Figure 5A:
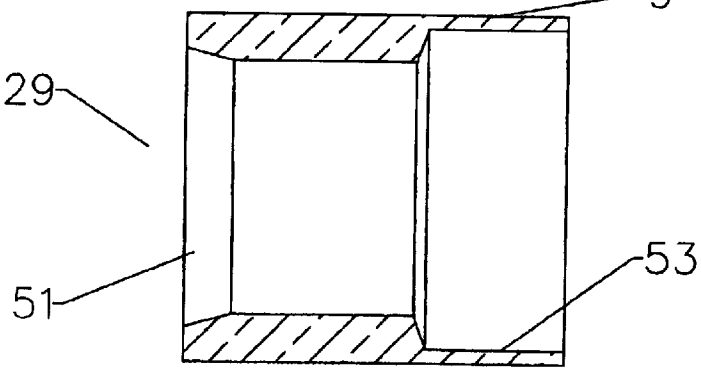
FIG. 5*a* is a cross sectional side view of the sleeve of FIG. 1.

FIGS. 5*a–c* show the sleeve 9 in greater detail. A cable guide surface 51 formed in the cable end 29 may be angled to assist initial insertion of the cable. A body mounting surface 53 at a connector end 17 has an inner diameter adapted to mate with the sleeve mounting surface 37 in an interference fit. A textured grip surface 55 or the like may be formed around the outer diameter of the sleeve 9 to improve the grip of a user upon the connector 1 when tightening the coupling nut 3.

The connector 1 may be pre-configured for use by assembling the components and applying limited axial compression to partially seat the interference fit surfaces together as shown in FIG. 1. This provides a user with a single assembly to handle, and removes the opportunity to misplace and or damage the individual connector 1 components.

To install the connector 1 upon a coaxial cable, the user prepares the cable end by stripping back portions of the outer conductor and outer sheath to expose the inner and outer conductors. The cable is then inserted into the cable end 29 of the connector 1 up to the interface area 49 where the connector 1 is rotated to thread the outer conductor thread(s) 47 upon the helical corrugations of the outer conductor. The threading is continued until a leading edge of the outer conductor is bottomed against the outer conductor groove 33.

Axial compression is applied to complete the interconnection. Depending upon the cable dimensions and deformation characteristics of the outer conductor material, the axial compression may be applied, for example, using a suitable hydraulic press and or a common hand tool. During axial compression, the interference fit surfaces between the sleeve 9 and the body 7 and also between the body 7 and the interface 5 are fully seated up to their respective stop points. Also, the relative movement compresses the second gasket 13 between the body 7 and the coupling nut 3 and the third gasket 15 between the sleeve 9 and the cable sheath, environmentally sealing the connector 1.

The leading edge of the outer conductor of the cable, already bottomed against the outer conductor groove 33, is further driven against the outer conductor groove 33 by the axial compression and deformed against and within same due to the threaded engagement between the outer conductor and the outer conductor threads 47 which lock the outer conductor to the body 7 as it is moved towards the interface 3.

Figure 6:
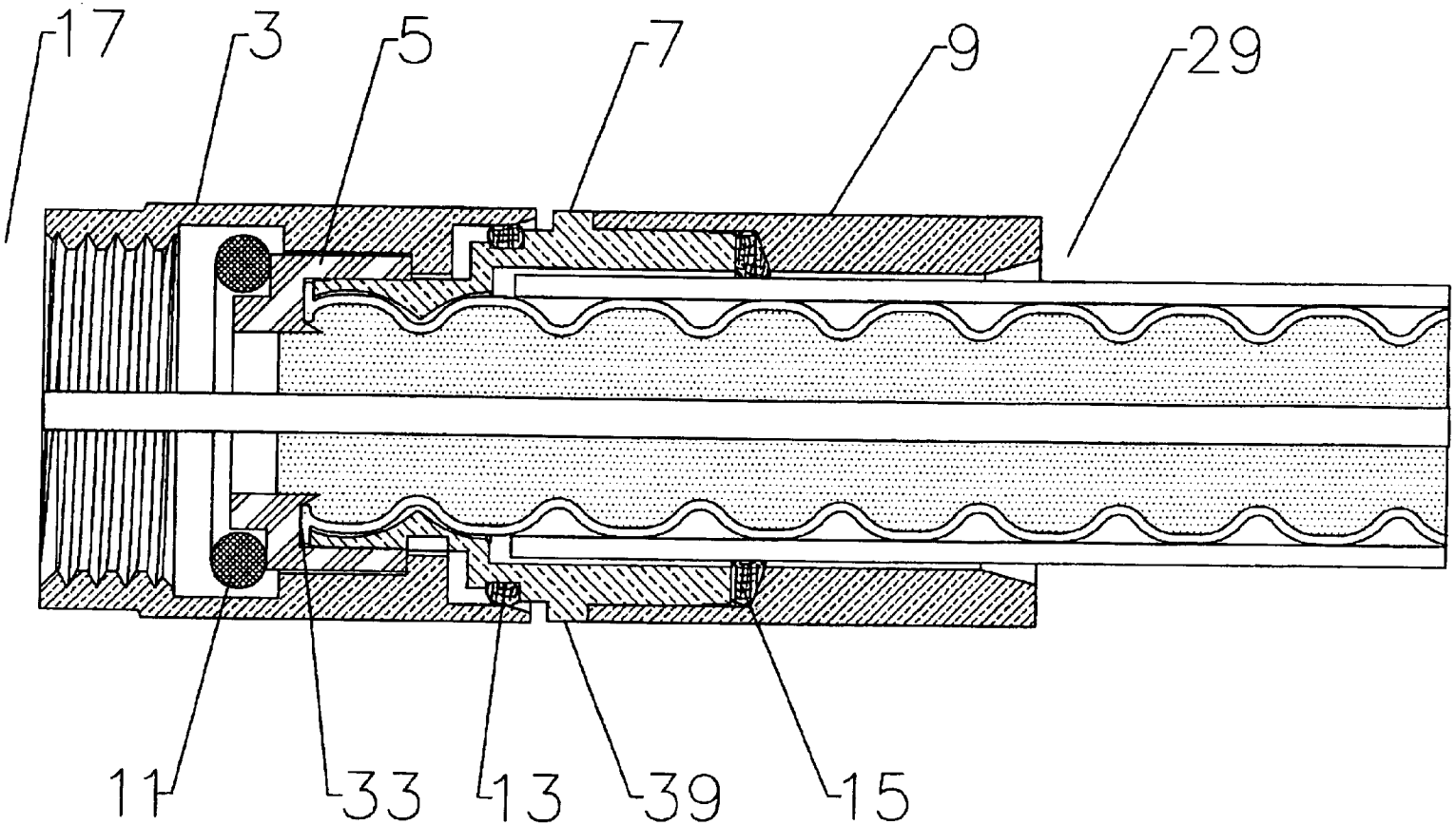
FIG. 6 is a cross sectional side view of the connector of FIG. 1, installed upon a cable.

The deformation of the leading edge of the outer conductor into the outer conductor groove 33 creates a strong electrical interconnection around the full diameter of the outer conductor leading edge. Further, the deformation disrupts the helical corrugations forward of the interface area 49 whereby as shown in FIG. 6, the connector 1 is fixed in place upon the cable, prevented from unthreading.

Figure 7:
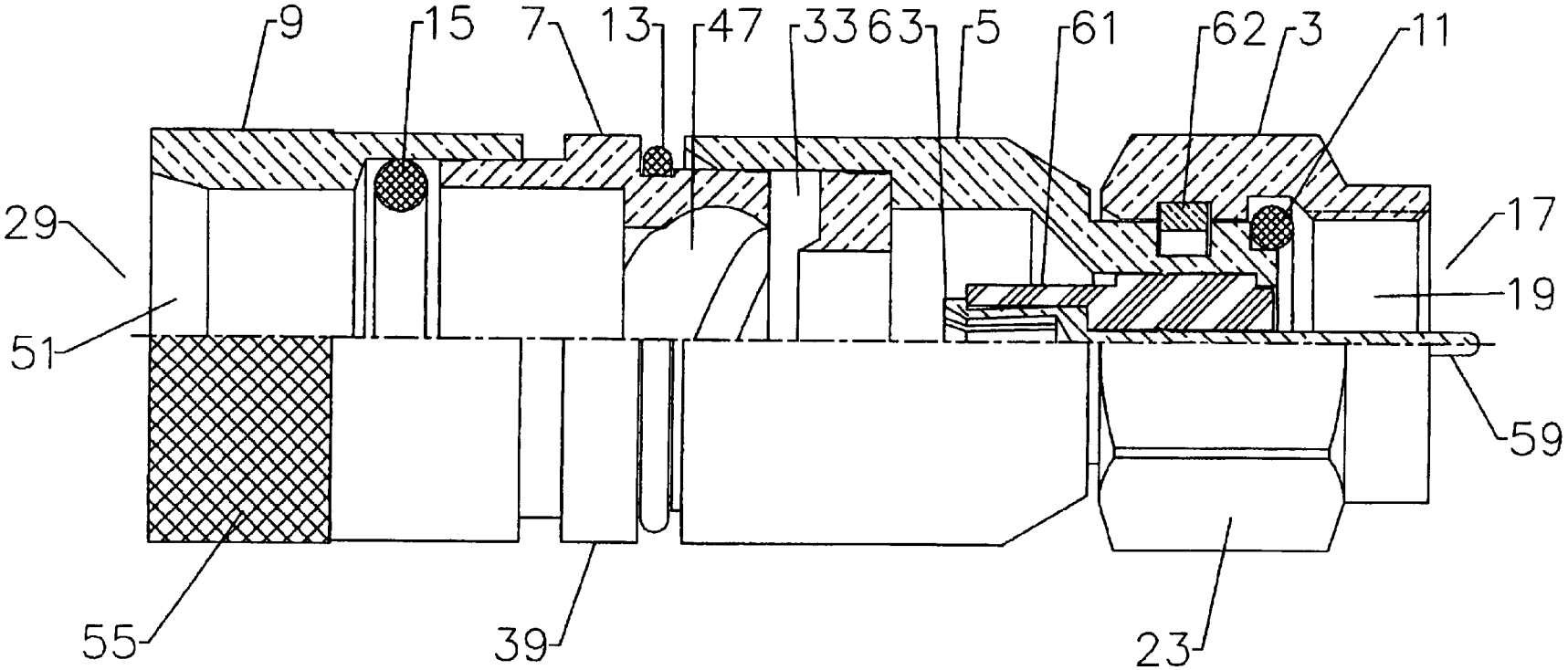
FIG. 7 is a combination external side view and partial cross sectional view of a connector according to a second embodiment of the invention.

In alternative embodiments, for example as shown in FIG. 7, like components/features numbered as above, a cable with, for example, a center conductor which has a larger diameter than the F-Type connector interface requires may be accommodated by modifying the interface 5. The interface 5 is adapted to include a center contact pin 59 held coaxially within the interface 5 by an insulator 61. Spring finger(s) 63 formed in the cable end 29 of the center contact pin 59 are biased radially inward to grasp a center conductor of the cable. To increase the inward bias, and thereby the strength of the interconnection with the center conductor, the insulator 61 supporting the center contact pin 59 may be extended towards the cable end 29 of the center contact pin 59 over a portion of the spring finger(s) 63 outer diameter.

Due to the increased dimension of the interface 5, the coupling nut 3 is not retained by an interconnection between the interface 5 and the body 7. Instead, a snap ring 62 or the like may be used to rotatably couple the coupling nut 3 to a connector end 17 of the interface 5. To simplify machining requirements of the interface 5, a separate flare compression ring 57 may be press fit into the interface 5 to form the outer conductor groove 33.

Similar to the first embodiment, described in detail herein above, during axial compression an interference fit is formed between the body 7 and the interface 5. Also, the leading edge of the cable outer conductor is driven into and deformed within the outer conductor groove 33. Rather than extending through the bores formed in the connector 1 the inner conductor of the cable engages spring fingers on the cable end of the center contact pin 1.

Figure 8A:
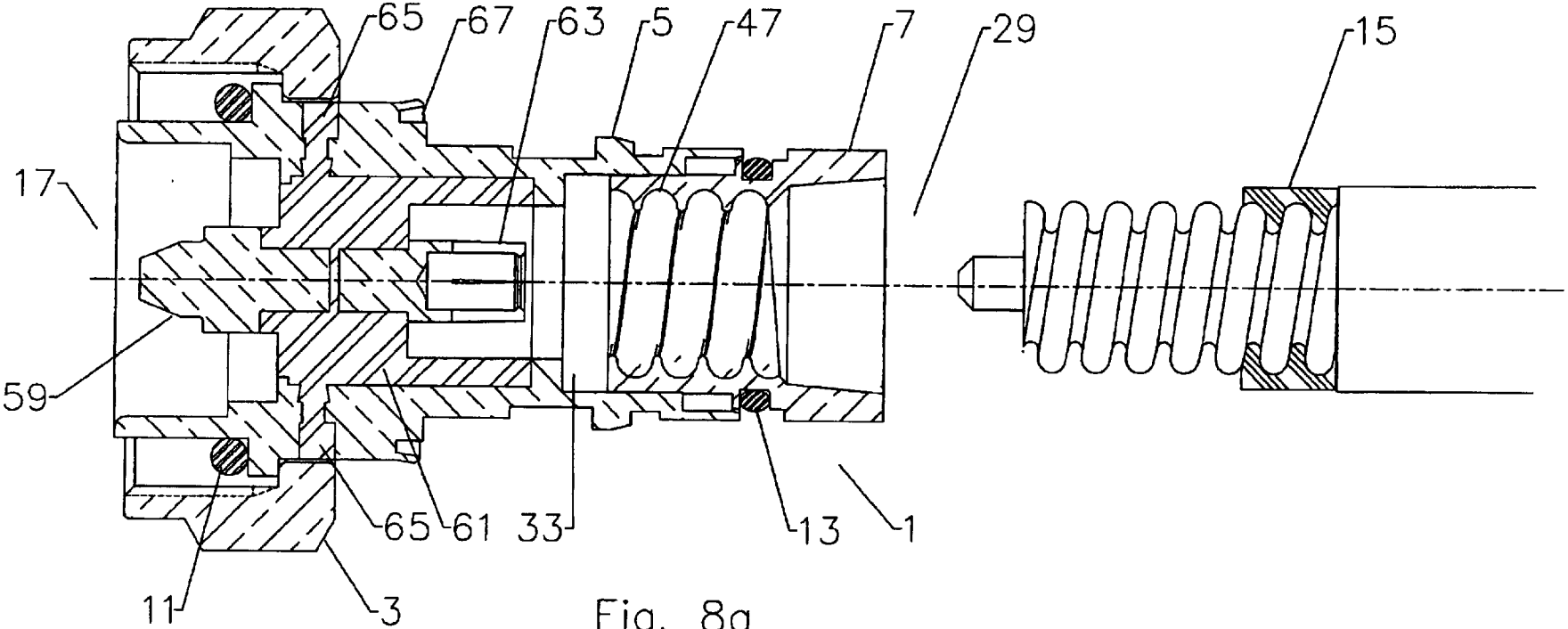
FIG. 8*a* is a cross sectional side view of a connector and partial cross sectional side view of a coaxial cable, prior to interconnection.
Figure 8B:
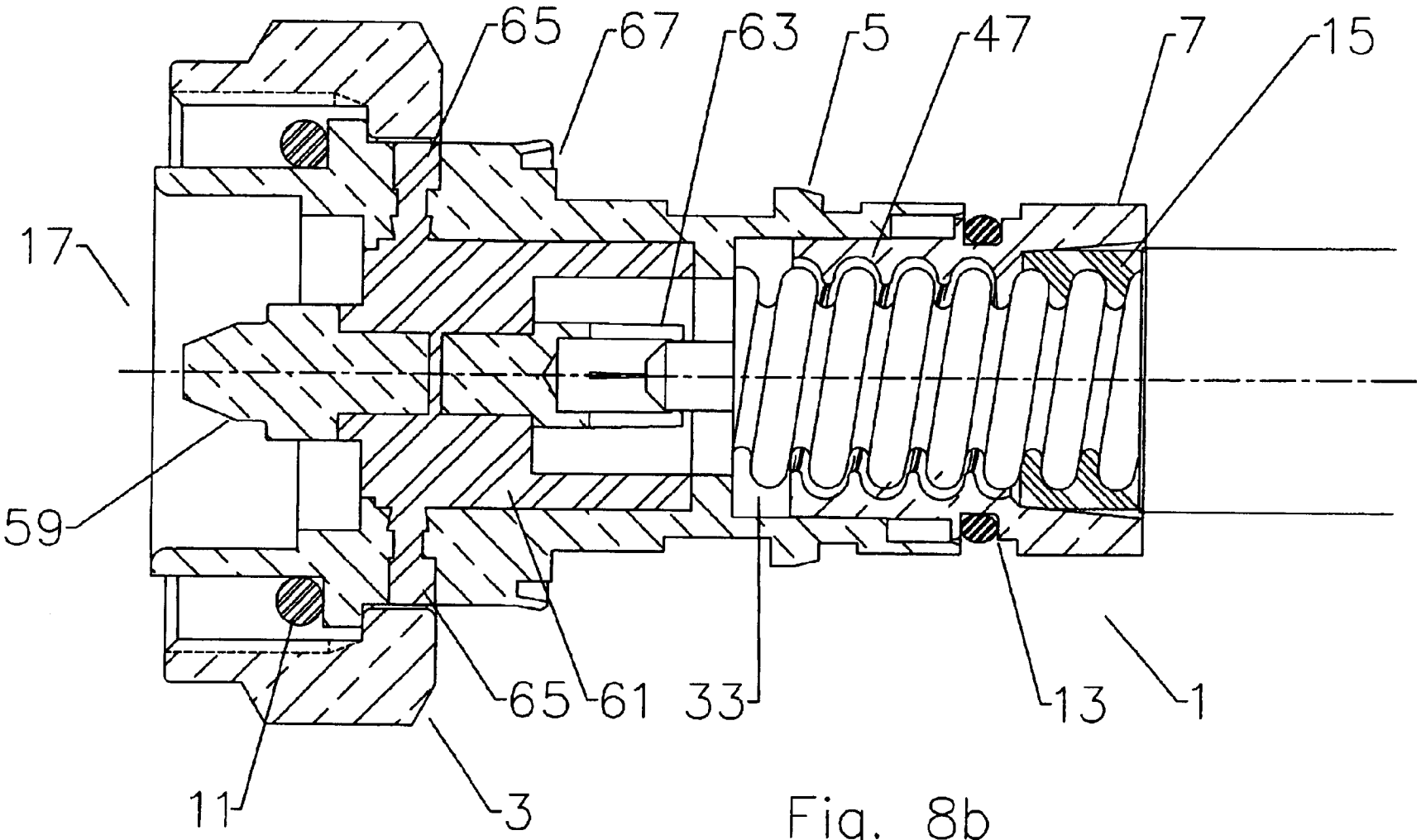
FIG. 8*b* is a cross sectional side view of a connector and partial cross sectional side view of a coaxial cable, prior to axial compression.
Figure 8C:
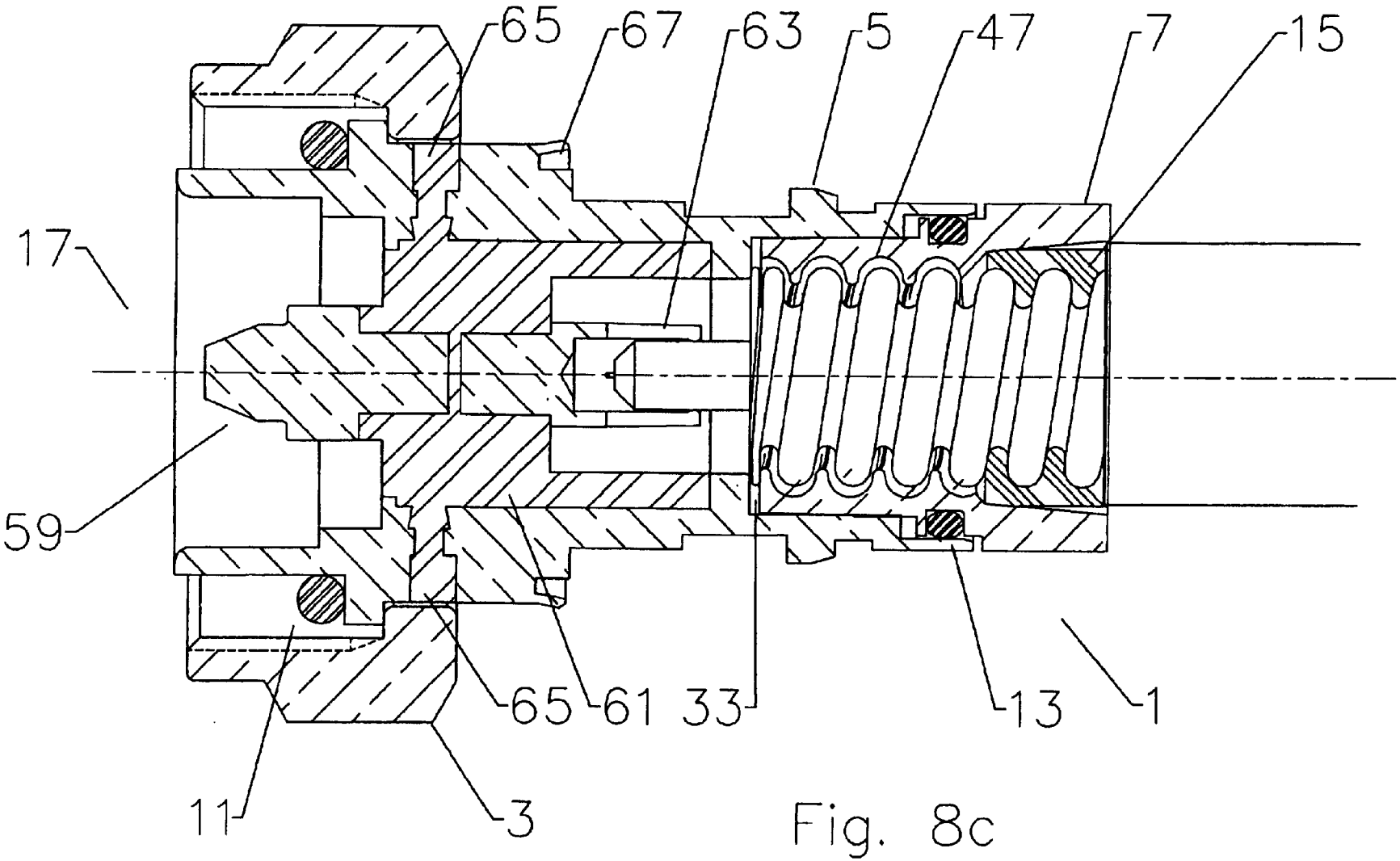
FIG. 8*c* is a cross sectional side view of a connector and partial cross sectional side view of a coaxial cable, installed.

Another embodiment, as shown in FIGS. 8*a–c*, like components/features numbered as above, is adapted for larger diameter cables and, for example, a standard 7/16 DIN connector interface. The insulator 61 supports the center contact pin 59. The insulator 61 may be preformed and press fitted into the interface 5. Alternatively, the center contact pin 59 may be temporarily supported in position and the insulator 61 formed in place by injection molding routed through injection molding entry and exit access port(s) 65 formed in the interface 5. The coupling nut 3 may be retained upon the interface 5 by deforming an outer edge of a cable end 29 facing retention groove 67 before or during the axial compression. The third gasket may be adapted to thread directly upon the outer conductor, sealing between the outer conductor and the body 7, eliminating the need for a separate sleeve component.

For installation, the cable is similarly prepared as shown in FIG. 8*a* and pre-threaded as described above and shown, for example, in FIG. 8*b*. Application of axial compression, then completes the deformation of the outer conductor and interface 5/body 7 interference fit interconnection, as shown in FIG. 8*c*.

Upon a review of this Specification, one skilled in the art will appreciate that the various interference fit surfaces described herein may be oriented in alternative configurations. Further, the connector interface may be a proprietary configuration or a standard interface, for example, Type F, SMA, DIN, Type N or BNC. Also, additional features may be included, for example, to provide seating surfaces for specific axial compression apparatus.

The invention provides a simplified and cost effective environmentally sealed connector with improved electrical characteristics. Depending upon the material characteristics and dimensions of the particular cable used, the connector may be quickly and securely attached using a compact hand tool. Further, the invention is applicable to a wide range of connector interfaces and helically corrugated outer conductor coaxial cables.

Table of Parts

| | |
|---|---|
| 1 | connector |
| 3 | coupling nut |
| 5 | interface |
| 7 | body |
| 9 | sleeve |
| 11 | first gasket |
| 13 | second gasket |
| 15 | third gasket |
| 17 | connector end |
| 19 | threads |
| 21 | retaining shoulder |
| 23 | faces |
| 25 | interface shoulder |
| 27 | body coupling surface |
| 29 | cable end |
| 31 | angled guide surface |
| 33 | outer conductor groove |
| 35 | sleeve mounting guide surface |
| 37 | sleeve mounting surface |
| 39 | ridge |
| 41 | groove |
| 43 | interface mounting surface |
| 45 | interface mounting guide surface |
| 47 | outer conductor thread(s) |
| 49 | interface area |
| 51 | cable guide surface |
| 53 | body mounting surface |
| 55 | grip surface |
| 57 | flare compression ring |
| 59 | center contact pin |
| 61 | insulator |
| 62 | snap ring |
| 63 | spring finger(s) |
| 65 | access port(s) |
| 67 | retention groove |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. An electrical connector for coaxial cable having a helically corrugated outer conductor, comprising:

a cylindrical body having an inner interface mounting surface adapted to threadably receive the outer conductor; and an interface adapted to couple with a connector end of the body in an interference fit via application of axial compression;

the interface having an angled guide surface projecting towards the body to form an outer conductor groove;

the application of axial compression operating to deform a leading edge of the outer conductor within the outer conductor groove, preventing unthreading of the outer conductor, thereby retaining the outer conductor within the electrical connector.

2. The connector of claim 1, further including a coupling nut with an inner retaining shoulder adapted to rotatably retain the coupling nut on the connector between the body and interface.

3. The connector of claim 2, further including a gasket located in a groove in an outer diameter of the body whereby the gasket seals between the coupling nut and the body.

4. The connector of claim 1, further including a sleeve adapted to couple to a cable end of the body in an interference fit via application of axial compression.

5. The connector of claim 4, further including a gasket located in an internal groove between the sleeve and the body; axial compression of the sleeve and the body compressing the gasket to form a seal between the cable end of the body and the coaxial cable.

6. The connector of claim 1, wherein the connector is adapted to interface with a Type F female connector.

7. The connector of claim 1, wherein the interface mounting surface has a pair of threads, each of the threads oriented 180 degrees from each other.

8. The connector of claim 4, further including a ridge formed around the body against which the sleeve bottoms upon axial compression of the body and the sleeve.

9. The connector of claim 1, wherein the interference fit between the body and the interface is formed between an interface mounting surface located on an outside diameter of the connecter end of the body and a body coupling surface on an inside diameter of a cable end of the interface.

10. The connector of claim 9, wherein an interface mounting guide surface having a smaller diameter that the interface mounting surface is located adjacent the interface mounting surface, proximate the connector end of the body.

11. An electrical connector for coaxial cable having a helically corrugated outer conductor, comprising:

a cylindrical body having an inner interface mounting surface adapted to threadably receive the outer conductor; and an interface adapted to couple with a connector end of the body in an interference fit via application of axial compression;

the axial compression of the interface and the body together deforming a leading edge of the outer conductor, coupling the outer conductor to the connector.

12. The connector of claim 11, wherein the interface has a center contact pin located coaxially within the interface by an insulator.

13. The connector of claim 11, wherein the interface has at least one access port interconnecting an outside diameter of the interface with an inside diameter.

14. The connector of claim 11, further including a coupling nut adapted to mount rotatably upon an outside of the interface.

15. The connector of claim 14, further including a cable end facing retention groove formed in the interface with an outside edge that is deformable in a radial direction to form a projection which retains the coupling nut upon the interface.

16. The connector of claim 11, further including a gasket adapted to thread upon the helical corrugations of the outer conductor and seal against the body upon threading of the cable into the body.

17. An electrical connector for coaxial cable having a helically corrugated outer conductor, comprising:

a cylindrical body having an inner interface mounting surface adapted to threadably receive the outer conductor; and an interface adapted to couple with a connector end of the body in an interference fit via application of axial compression;

the interface having an angled guide surface projecting towards the body to form a cable end facing outer conductor groove between the angled guide surface and the interface;

the application of axial compression operating to deform a leading edge of the outer conductor within the outer conductor groove, preventing unthreading of the outer conductor, thereby retaining the outer conductor within the electrical connector.

18. The connector of claim 17, further including a center contact pin positioned coaxially within the interface by an insulator.

19. The connector of claim 18, further including a plurality of spring fingers on a cable end of the center contact pin;

the spring fingers biased radially inward to grasp a center conductor of the cable upon axial compression of the connector.

20. The connector of claim 19, wherein the insulator extends over at least a portion of an outer radius of the spring fingers.

* * * * *